US009262987B2

(12) United States Patent
Albrecht et al.

(10) Patent No.: US 9,262,987 B2
(45) Date of Patent: Feb. 16, 2016

(54) COMPENSATION METHODS FOR DISPLAY BRIGHTNESS CHANGE ASSOCIATED WITH REDUCED REFRESH RATE

(71) Applicant: Apple Inc., Cupertino, CA (US)

(72) Inventors: Marc Albrecht, San Francisco, CA (US); Christopher Philip Alan Tann, San Jose, CA (US); Nicholas G. Roland, San Jose, CA (US)

(73) Assignee: Apple Inc., Cupertino, CA (US)

( * ) Notice: Subject to any disclaimer, the term of this patent is extended or adjusted under 35 U.S.C. 154(b) by 335 days.

(21) Appl. No.: 13/801,918

(22) Filed: Mar. 13, 2013

(65) Prior Publication Data

US 2014/0267370 A1 Sep. 18, 2014

(51) Int. Cl.
*G09G 5/00* (2006.01)

(52) U.S. Cl.
CPC ..... *G09G 5/006* (2013.01); *G09G 2320/0626* (2013.01); *G09G 2330/022* (2013.01); *G09G 2340/0435* (2013.01); *G09G 2360/18* (2013.01)

(58) Field of Classification Search
CPC ..... G09G 2320/0626; G09G 2340/0435
USPC ..... 345/102; 349/61–71; 362/97.1–97.4
See application file for complete search history.

(56) References Cited

U.S. PATENT DOCUMENTS

| | | | |
|---|---|---|---|
| 8,094,286 B2 | 1/2012 | Bourdon et al. | |
| 2008/0049006 A1 | 2/2008 | Yi et al. | |
| 2009/0058763 A1 | 3/2009 | Doi et al. | |
| 2010/0053225 A1* | 3/2010 | Furukawa et al. | 345/690 |
| 2011/0096067 A1 | 4/2011 | Guo et al. | |
| 2012/0182332 A1 | 7/2012 | Liu | |
| 2012/0236013 A1 | 9/2012 | Wyatt et al. | |

FOREIGN PATENT DOCUMENTS

| | | |
|---|---|---|
| CN | 101523476 | 9/2009 |
| CN | 101573745 | 11/2009 |
| CN | 102930839 | 2/2013 |
| EP | 2116992 | 11/2009 |
| EP | 2557560 | 2/2013 |
| TW | 200917224 | 4/2009 |
| TW | 201232516 | 8/2012 |

* cited by examiner

*Primary Examiner* — Michael Pervan
(74) *Attorney, Agent, or Firm* — Zachary D. Hadd

(57) ABSTRACT

A method is provided for compensating for brightness change in a display. The method includes storing a plurality of look-up tables (LUTs), where each table has a plurality of pixel levels at a variable refresh rate (VRR) and a plurality of brightness signals that provide compensation for the brightness change when refresh rate is changed during a panel self-refresh (PSR). The method also includes receiving an input signal from a graphics processing unit (GPU) and determining the VRR of the input signal from the GPU. The method further includes obtaining the LUT at the determined VRR of the input signal and adjusting the input signal to produce an output signal that compensates for the brightness change for each pixel or sub-pixel in a timing controller based upon the LUT at the determined VRR. The method further includes transmitting the output signal to the display. A system is also provided.

22 Claims, 3 Drawing Sheets

COMPENSATION METHODS FOR DISPLAY BRIGHTNESS CHANGE ASSOCIATED WITH REDUCED REFRESH RATE

TECHNICAL FIELD

Embodiments described herein generally relate to panel self-refresh (PSR) of a display. More specifically, certain embodiments relate to methods for compensating brightness change caused by a change in refresh rate.

BACKGROUND

A panel self-refresh (PSR) updates a display at a reduced refresh rate. Generally, the reduced refresh rate is lower than a frame rate of the display, which is normally 60 Hz. When the display is updated at a reduced refresh rate, less power may be consumed because each updating of the display requires certain power consumption. For example, if the display is refreshed at a refresh rate of 30 Hz during a panel self-refresh (PSR), or even lower refresh rate, the display reduces usage of the power. However, when the refresh rate of the display is lowered to save power, the display may show a reduced brightness or otherwise become dimmer to the extent that this change in brightness may be perceivable by a human eye. Thus, it is desirable to develop methods to enable power savings in a display without impacting visual effect or brightness.

SUMMARY

Embodiments described herein may provide methods and systems for compensating for a brightness change due to entering or exiting variable refresh rate (VRR) or due to reduced refresh rate during a panel self-refresh (PSR). This compensation may be performed on a pixel or a sub-pixel level, and may help save power consumed in the display while simultaneously limiting a user's notice of any change in brightness of the display. In some embodiments, the compensation is achieved by a timing controller that receives a signal from a graphics processing unit (GPU), and transmits a compensated signal or adapted pixel values to a display. The timing controller performs the compensation based upon look-up tables (LUTs) stored in a buffer. The adapted pixel values may be obtained based upon the LUTs and original pixel values. For example, the adapted pixel values may be increased from the original pixel values to compensate for the brightness change to obtain the desired brightness at a default refresh rate, such as 60 Hz. The LUTs are generated based upon brightness measurements for various pixel levels or sub-pixel levels for color display panels at a given VRR or a reduced refresh rate and a frame rate of the display panels. Each LUT includes a compensation value at various pixel levels. The compensation value may be delta brightness between the brightness at a default refresh rate (e.g. 60 Hz) and the brightness at a reduced refresh rate or actual brightness at a reduced refresh rate for a given color. The delta brightness at each pixel level provides a compensation for a brightness change of a pixel at a given refresh rate. Generally, the compensation may be applied on a pixel or per-pixel basis. When implementation of the look-up table (LUT) in a timing controller (T-CON), the implementation has low hardware cost.

In one embodiment, a method is provided for compensating for brightness change in a display. The method includes storing a plurality of look-up tables (LUTs), where each table has a plurality of pixel levels at a reduced refresh rate and a plurality of brightness signals that provide compensation for the brightness change when refresh rate is changed during a panel self-refresh (PSR). The method also includes receiving an input signal from a graphics processing unit (GPU) and determining the reduced refresh rate of the input signal from the GPU. The method further includes obtaining the LUT at the determined reduced refresh rate of the input signal and adjusting the input signal to produce an output signal that compensates for the brightness change for each pixel or sub-pixel in a timing controller based upon the LUT at the determined reduced refresh rate. The method further includes transmitting the output signal to the display.

In another embodiment, a display system is provided with a compensation for a brightness change when a refresh rate is changed during a panel self-refresh phase. The system includes a time controller that has a receiver, a transmitter, and a memory storing a plurality of look-up tables (LUTs). Each table has a plurality of pixel levels at a reduced refresh rate and a plurality of brightness signals compensating for the brightness change. The system also includes a graphics processing unit (GPU) coupled to the receiver of the time controller, and a display coupled to the transmitter of the time controller. The time controller is configured to compensate for the brightness change for an individual pixel or a sub-pixel based upon the plurality of LUTs at the reduced refresh rate of the input signal.

Additional embodiments and features are set forth in part in the description that follows, and in part will become apparent to those skilled in the art upon examination of the specification or may be learned by the practice of the embodiments discussed herein. A further understanding of the nature and advantages of certain embodiments may be realized by reference to the remaining portions of the specification and the drawings, which forms a part of this disclosure.

DETAILED DESCRIPTION

Figure 1:
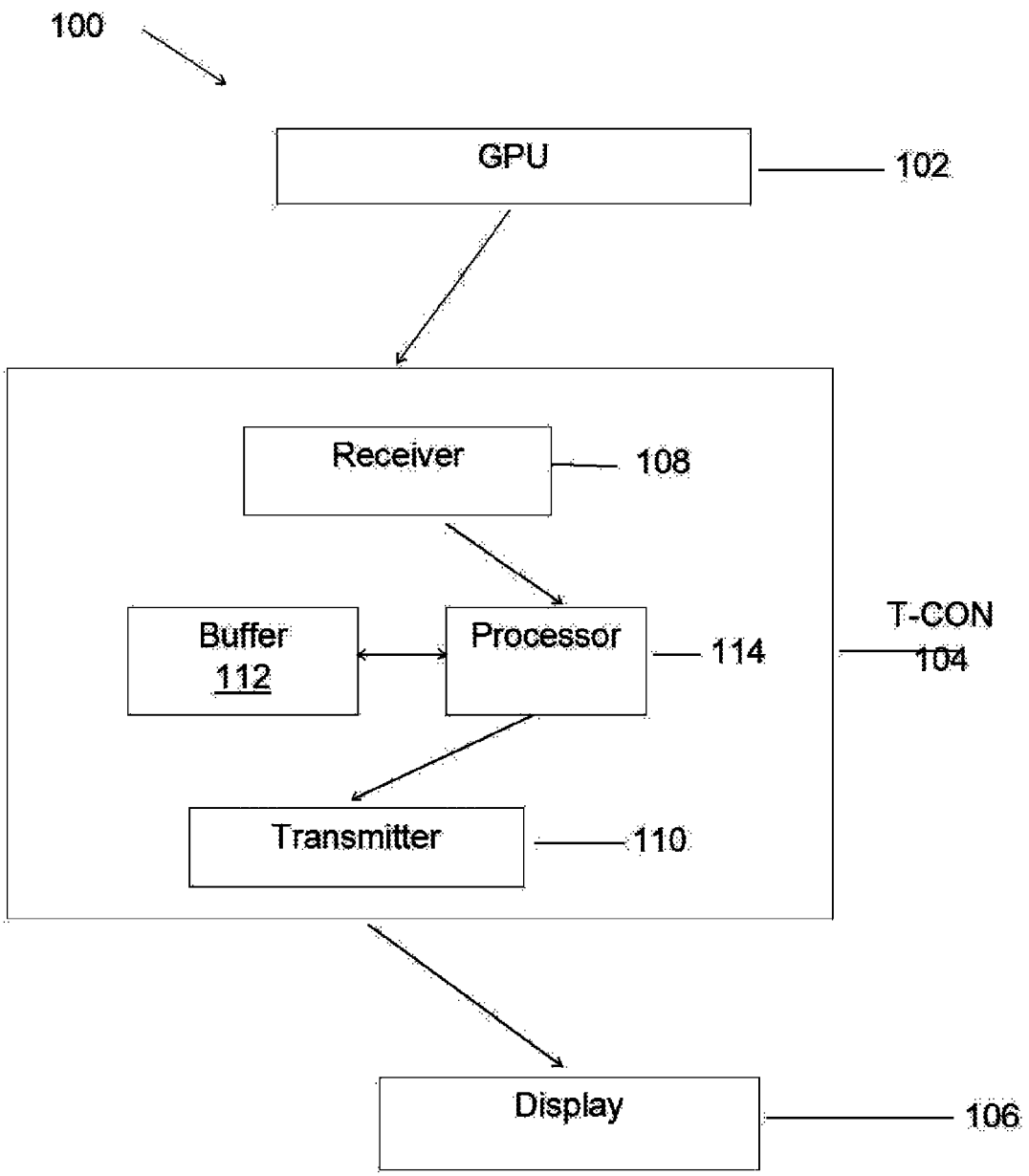
FIG. 1 illustrates a system diagram for a display according to embodiments of the present disclosure.

The present disclosure may be understood by reference to the following detailed description, taken in conjunction with the drawings as described below. It is noted that for purposes of illustrative clarity, certain elements in various drawings may not be drawn to scale.

The present disclosure provides apparatuses and methods for compensating for a possible brightness change that may occur when the refresh rate of a display is lowered, especially during a refresh phase of the display's operation. The refresh rate may, for example, be lowered during such a self-refresh phase and raised during another sequence or operation of the display panel. Thus, the panel may have a variable refresh rate.

Compensation may occur on a pixel or sub-pixel basis if the predicted or actual, uncompensated brightness change of the display is relatively large when the refresh rate drops. For a specific display panel, the brightness for each pixel level may be measured at various refresh rates and compared to a default brightness at a default operating refresh rate, such as 60 Hz.

Based on the brightness measurements at the reduced refresh rate and the default operating refresh rate, a LUT may be generated to include a compensation value, such as a delta brightness between the brightness at the reduced refresh rate and the default brightness at the default operating refresh rate for different gray levels or actual brightness at a reduced refresh rate. The LUT, by supplying the compensation value to a processor or graphics unit, permits adjustment of any pixel brightness values at the reduced refresh rate to the adapted pixel brightness values by adjusting original pixel values (e.g. pixel levels in Table 1, or input voltage to the pixels) to adapted or desired pixel values (e.g. adjusted input voltage or gray levels) far the pixel(s). The adapted pixel brightness values (e.g., the brightness after applying the delta or other compensation factor in the LUT) are equal to, or near to, the brightness of the pixels at a standard or default refresh rate. For example, a display's brightness generally varies across its pixels or sub-pixels. The compensation for the brightness at the reduced refresh rate likewise may vary with the pixels or sub-pixels. Essentially, the LUT provides a compensation value that may compensate for a change in a pixel's brightness due to a change in the display refresh rate.

Alternatively, the LUT may include a brightness value at the reduced refresh rate for various gray levels instead of a change or delta in brightness. The adapted pixel brightness values or the brightness of the display at a standard or default refresh rate, such as 60 Hz, may also be stored in the LUT or stored somewhere, such as in a buffer. Further, the adapted pixel values may be estimated based the original pixel values and the compensation value in the LUT. The delta brightness at each pixel or gray level is the compensation required for each gray level.

In some embodiments, a compensation value for a pixel's brightness at a reduced refresh rate may be obtained by linear interpolation of the brightness compensation values for the pixel at refresh rates nearest the reduced refresh rate. That is, if a particular compensation factor for a specific reduced refresh rate is not stored in any LUT, an embodiment may interpolate between two compensation values from two LUTs for the same pixel level, each LUT corresponding to a nearest neighbor refresh rate.

In some embodiments, the brightness at the reduced refresh rate may be measured for different colors, such as red, green, and blue at various refresh rates. The measurements may be performed with a standard backlight, a standard temperature such as room temperature, or a standard transmissivity of pixels. Correction factors or compensation factors for the brightness may be obtained for other backlights, temperatures, or transmissivities.

The present disclosure also provides methods for compensating for a predicted brightness change for the entire display (e.g., all pixels) if the predicted brightness change due to changes in the refresh rate of the display is relatively small. That is, for large brightness changes, brightness of individual pixels or sub-pixels may be adjusted while for small overall brightness changes, the brightness of the entire display may be adjusted. When the brightness changes are small, there may be no need to adjust each pixel individually based upon the values in the LUT, because the differences among brightness levels of different pixels are small enough to be ignored. Accordingly, power consumption by the display may be reduced as the refresh rate is reduced; generally, the additional brightness of any given pixel or set of pixels consumes less power than operating the display at the higher refresh rate. Thus, the lower the refresh rate, the greater the power savings in certain embodiments.

FIG. 1 illustrates a system diagram for a display according to embodiments of the present disclosure. In some embodiments, display system 100 includes a display 106, a graphics processing unit (GPU) 102, and a timing controller (T-CON) 104. The T-CON 104 may be coupled to both the display 106 and the GPU 102. The T-CON 104 may receive video image and frame data from one or more components, such as GPU 102, of the display system. As the T-CON 104 receives these signals, it may process the signals and transmit them in a format that is compatible with display 106. The display 106 may be of any variety, including liquid crystal displays (LCDs), organic light emitting diode (OLED) displays, or the like.

GPU 102 generates data which may be communicated to the T-CON 104. For example, GPU 102 may generate video image data along with frame and line synchronization signals during an operation of a display system 100. The frame synchronization signal generally synchronizes a series of frames so that they may be sequentially shown on the display 106. Each frame may be separated at a vertical blanking ($V_{blank}$) interval in the frame synchronization signal.

Generally, the number of frames per unit time and the length of the vertical blanking interval combine to determine the refresh rate of the display. Thus, for a display 106 operating at 60 Hz, 60 frames are shown every second: each is separated by a vertical blanking interval. By extending the duration of $V_{blank}$ and reducing the number of subsequent frames, the refresh rate of the display may be adjusted while the duration of any given frame remains constant. Essentially, the duration of a frame remains unchanged while the duration of $V_{blank}$ increases, thereby changing the refresh rate of the display 106. Decreasing the panel refresh rate may be done when video is not being displayed, inputs have not been acquired by an associated computing system for a certain period of time, and/or when other frame-intensive operations are not occurring, but complete blanking of the display is not desired.

Furthermore, the line synchronization signals may include a horizontal blanking interval in between successive lines of video data.

In some embodiments, a number of GPUs (not shown) may be coupled to the T-CON 104, which may control switching from one GPU to another GPU. The number of GPUs may have different operational capabilities (e.g. more or less graphical capabilities), or different power consumptions (e.g. consume more or less power).

T-CON 104 controls or manages the update of the display or panel 106. For example, T-CON 104 includes a receiver 108 that receives an input signal, such as a video signal from GPU 102, and may apply a compensation to the input signal to adjust a brightness of the display and/or certain pixels in order to offset a decreased brightness that may occur when the refresh rate of the display is lowered. In some embodiments, one or more LUTs may store the compensation factors for different pixels or sub-pixels at different refresh rates. Likewise, a LUT may store a change in brightness for any given pixel between a default refresh rate and a reduced refresh rate. As an example, and as described further below, compensation may vary based on the color outputted by the pixel or sub-pixel, the refresh rate of the display, the brightness level of the pixel or sub-pixel on the display, the location of the pixel on the display, and so forth.

T-CON 104 may also include a transmitter 110 that transmits the output signal to the display 106. T-CON 104 may process the input signal and output a modified, compensated signal in a format that is compatible with display 106. In addition to sending these signals to the display 106, the T-CON 104 also may send these signals to buffer 112 for storage.

T-CON 104 may also include a processor 114 for managing operations of, and communicating control signals and other signals to, various components within the display system. Although the processor 114 is shown as an internal component to the T-CON, the processor may also be external to the T-CON. For example, the processor 114 may be included in an associated computing device such as a laptop computer, a desktop computer, server, tablet computing device, smart phone, wearable accessory, digital media player, and so on. The processor is operationally coupled to the T-CON.

In some embodiments, the T-CON 104 may include an internal buffer 112 as illustrated in FIG. 1. The T-CON 104 may also be coupled to an external buffer (not shown), such as in a host computer and the like. The external buffer may be coupled to the T-CON. The buffer 112, either internal or external, may take the form of a physical memory or other storage for storing data, which may include any or all of one or more LUTs, input signals from the GPU 102 and output signals to the display 106. The buffer 112 may also convert a signal from a first refresh rate to a second refresh rate. For example, the buffer 112 receives a signal at a frame rate of 60 Hz and outputs a signal at a refresh rate of 30 Hz. More details are disclosed in U.S. patent application Ser. No. 12/347,491, which is incorporated herein by reference.

Furthermore, the format of data stored in the buffer 112 may vary. For example, in some embodiments, the data may be stored in the buffer 112 for red, green, blue channels at varying resolutions or corresponding to different refresh rates so that the data may be directly displayed, in other embodiments, the video data may be stored in the buffer 112 in a format such that the T-CON 104 decodes the stored data prior to transmitting to the display 106. The stored data may, for example, be converted from one refresh rate to another refresh rate during decoding in the buffer.

Generally, the brightness of many displays varies with a refresh rate of the displays. Certain displays may exhibit uniform or relatively uniform changes to brightness as the refresh rate changes (e.g., the entirety of the display exhibits a change in brightness). Other displays may have certain pixels change more markedly in brightness than others as refresh rate changes. For example, brighter pixels in a displayed image may be more greatly affected than darker pixels. Likewise, pixels emitting certain colors may have a greater or lesser change in brightness as refresh rate changes. Many displays may become perceptibly dimmer as the refresh rate decreases. As one example, changing a refresh rate of a display from 60 Hz to 30 Hz is typically noticeable to the average viewer. Likewise, such a change typically is most noticeable in pixels having an average luminance and/or grayscale value, rather than in pixels at the extremes.

The brightness values at the reduced refresh rate or delta brightness values in the LUT may be measured at various pixel levels for a number of refresh rates, such as 60 Hz, 50 Hz, 40 Hz, 30 Hz, 25 Hz, 20 Hz, 15 Hz, 10 Hz, and 5 Hz among others. In some embodiments, the display includes an array of pixels, where each pixel has a number of pixel levels or gray levels. For example, each pixel may have a pixel gray level ranging from 0 to 255 in a 10-bit non-linear pixel space or 8-bit pixel space.

The brightness values at the reduced refresh rate or delta brightness values in the LUT may also be measured at different sub-pixel levels for each color, such as red, green, and blue color at a given variable refresh rate (VRR), where any reduced refresh rate is a subset of a VRR range. In some embodiments, the display is a colored panel. The display includes an array of pixels, where each pixel may include several sub-pixels, such as red, green, and blue. Each sub-pixel may have a sub-pixel level ranging from 0 to 255 in a 10-bit pixel space or 8-bit pixel space.

It should be appreciated that the LUTs and compensation described herein may be common to all models of a given display. For example, the brightness values at the reduced refresh rate or delta brightness values in the LUT may be measured for a new type of display panel once and may be used for a production line of the new type of display panel. Specifically, for a number of display panels of the same type or design, the same LUT may be used as long as a common electrode of each of the display panels is calibrated in the same way. For example, one may measure brightness at a frame rate of 60 Hz for all pixel levels, such as from 0 to 255. It will be appreciated by those skilled in the art that the total number of pixel levels may vary. The total number of pixel levels depends upon how the display panel changes its brightness at lower refresh rate and other properties of the panel. The measured brightness at the frame rate of the display (e.g. 60 Hz) is the desired intensity to which the brightness at a lower refresh rate will be matched. A delta brightness at any given VRR is the difference between the brightness at the frame rate of the display and the brightness at the VRR.

In some embodiments, although it is expected that the delta brightness between 60 Hz and a VRR or the actual brightness at the VRR is the same for each panel of the same type, the pixel brightness may still be measured for each individual panel, because a gamma test is generally performed for each individual panel.

Table 1 illustrates an example LUT according to embodiments of the present disclosure. LUT may include a column of pixel levels and corresponding actual brightnesses at a reduced refresh rate. For each pixel brightness level n, Rn, Gn, and Bn may represent the actual brightness at the corresponding refresh rate for a red color (R) sub-pixel, green color (G) sub-pixel, and blue color (B) sub-pixel, where n is an integer. R1 may be different from R2 or Rn. Gn may be different from Rn or Bn. For example, presume the VRR is 30 Hz. Rn may represent an actual brightness at 30 Hz. In some embodiments, Rn may represent a delta brightness between the brightness at the VRR (e.g. 30 Hz) and the brightness at the default refresh rate, as the brightness at the default refresh rate (e.g. 60 Hz) for all pixel levels and different colors are measured or known.

TABLE 1

Example Look-up Table (LUT) at a VRR

| Pixel Level | Red | Green | Blue |
|---|---|---|---|
| 0 | R1 | G1 | B1 |
| 1 | R2 | G2 | B2 |
| 2 | R3 | G3 | B3 |
| . | | | |
| . | | | |
| . | | | |
| n | Rn | Gn | Bn |

Generally, the buffer 112 stores a limited number of LUTs for compensation of brightness changes when entering or exiting a VRR during the PSR. When a desired refresh rate is not available in the buffer, the LUT at the desired refresh rate may be obtained by linear interpolation based upon the known LUTs at other refresh rates. For example, to obtain a LUT at any given refresh rate, linear interpolation may be used to obtain a delta brightness based upon a delta brightness at a pixel level in a first LUT at a first refresh rate and a delta brightness at the same pixel level in a second LUT at a second refresh rate. For example, the first LUT may be at a refresh rate of 15 Hz and the second LUT may be at a refresh rate of 25 Hz. Both the first LUT and the second LUT are obtained by measurements and stored in the buffer. A third LUT at a refresh rate of 20 Hz is between the first refresh rate of 15 Hz and the second refresh rate of 25 Hz. The third LUT may be obtained by linear interpolations.

In some embodiments, the refresh rate may be fixed for a display 106. For example, display 106 may have a refresh rate of 30 Hz. The compensation for brightness change due to the refresh rate change from 60 Hz to 30 Hz may be performed by compensating the "delta" or change in brightness between the brightness at 60 Hz and the brightness at 30 Hz for individual pixel levels or sub-pixel levels to match to the brightness at 60 Hz for the respective individual pixel levels or sub-pixel levels, based upon the LUTs.

In other embodiments, the refresh rate may be ramped down during a PSR entry period as the refresh rate is reduced, or ramped up during a PSR exit period as the refresh rate is increased. The ramp up or down may further reduce a perceivable change in brightness.

Figure 2:
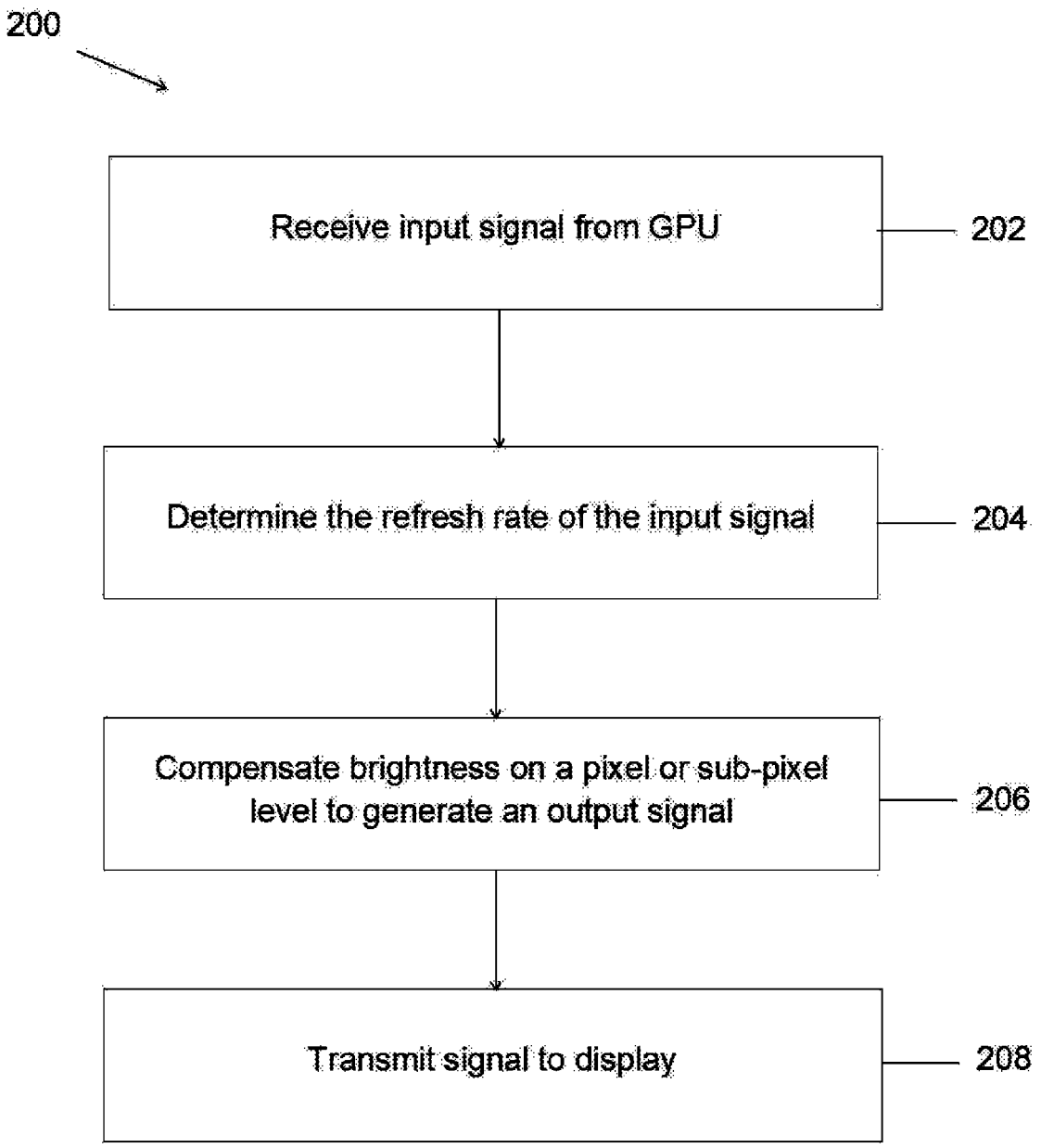
FIG. 2 is a flow chart illustrating steps for compensating brightness change when entering or exiting VRR during PSR according to embodiments of the present disclosure.

FIG. 2 is a flow chart illustrating steps for compensating brightness change when entering or exiting VRR during PSR according to embodiments of the present disclosure. Compensation process 200 includes receiving input signal from a GPU at operation 202, followed by determining the refresh rate of the input signal in the T-CON at operation 204. Once the refresh rate is known, the T-CON finds the LUT in the buffer and then compensating brightness on a pixel or sub-pixel level at operation 206. Process 200 also includes transmitting the adapted pixel values to the display at operation 208. By such a compensation process, the images on the display have no perceivable brightness to the user even when the refresh rate is significantly different from 60 Hz.

Generally, the pixel brightness operates in any bit space, such as a 6-bit, 8-bit, or 10-bit space which is nonlinear or in a 16-bit space which is linear. In a particular embodiment, the pixel brightness includes various levels ranging from 0, 1, 2, and n (e.g. 255) for each pixel or sub-pixel. If brightness changes are small, the brightness changes may be properly compensated over all the pixels rather than over each pixel or sub-pixel.

Figure 3:
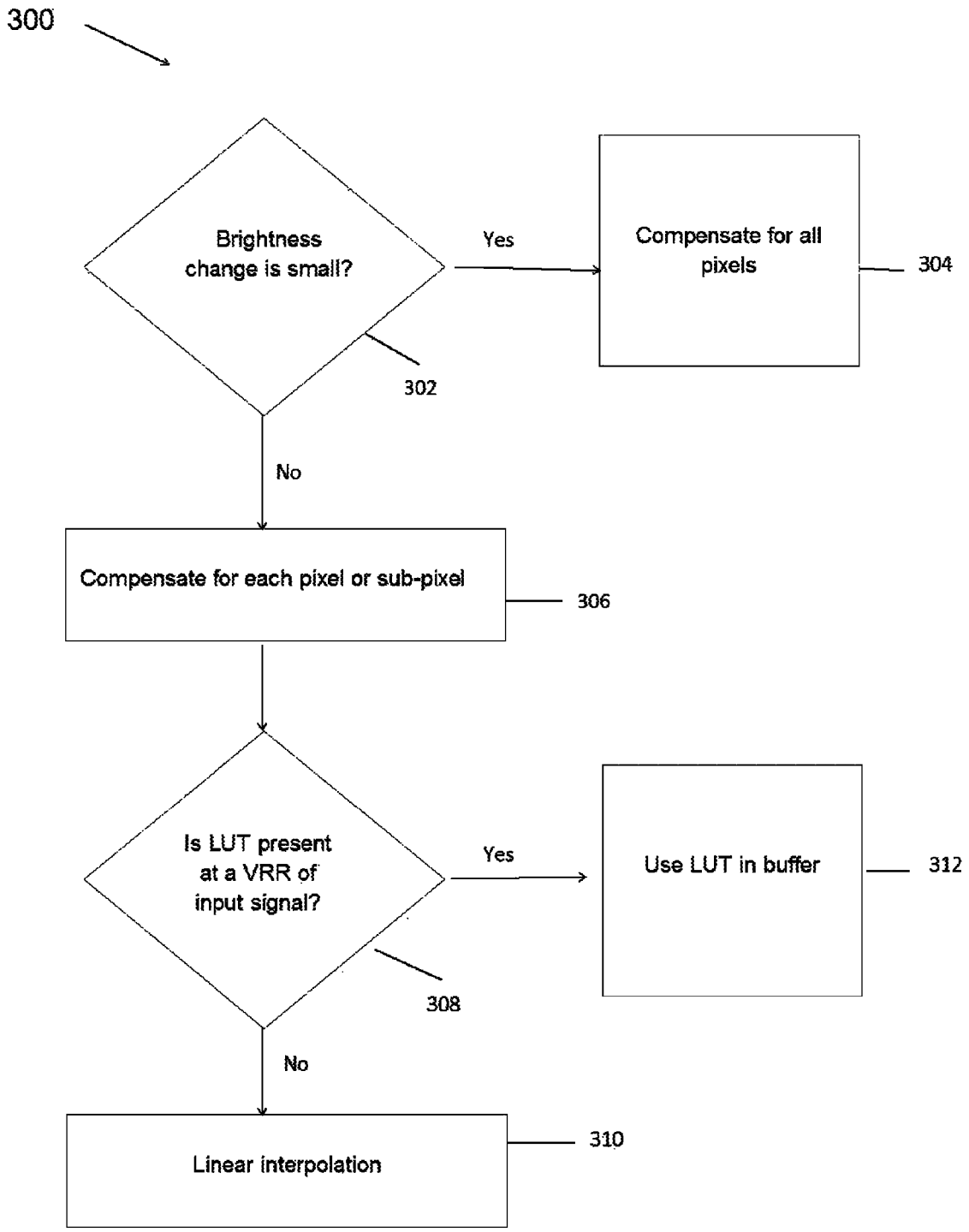
FIG. 3 is a flow chart illustrating process for compensating for brightness change according to certain embodiments of the present disclosure.

FIG. 3 shows a flow chart illustrating a process for compensating a brightness change according to certain embodiments of the present disclosure. If all the brightness changes are larger than a threshold at operation 302, then T-CON proceeds with compensating for the entire display at operation 304. The threshold may be empirically determined or may be in a range where the maximum brightness change in a pixel is below human perception when switching from one refresh rate to another refresh rate. The threshold is applied to all the pixel levels or sub-pixel levels. If the brightness changes are larger than a threshold, then the T-CON proceeds with compensating for each pixel or sub-pixel at operation 306. Prior to compensation for brightness, a LUT at the determined VRR is needed. If the LUT is present in the buffer, the T-CON uses the LUT in the buffer at operation 312. If the LUT is not available in the buffer, the T-CON performs linear interpolation as described earlier at operation 310. It will be appreciated by those skilled in the art that the operations may also be performed by a processor other than the T-CON.

The display may also include compensation for compensating a brightness change for the entire display, for example, due to backlight source, such as brighter or dimmer backlight. The display may further include compensation for temperature change, for example, due to cold or warm environment. The compensation for brightness or temperature generally does not vary with refresh rate or pixels. Compared to the compensation for brightness or temperature among others, adapting pixel values based upon LUTs in the T-CON may be more robust and reliable.

Having described several embodiments, it will be recognized by those skilled in the art, that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A method of compensating for a brightness change in a display that occurs when a refresh rate of the display is changed, the method comprising:

storing a plurality of look-up tables (LUT), each look-up table corresponding to a reduced refresh rate and having a plurality of pixel levels and a plurality of corresponding brightness signals that provide compensation for the brightness change when the refresh rate is changed to the reduced refresh rate during a panel self-refresh (PSR);

with a timing controller, receiving an input signal at the reduced refresh rate from a graphics processing unit (GPU);

obtaining the look-up table that corresponds to the reduced refresh rate of the input signal;

based on the obtained look-up table, adjusting the input signal to produce an output signal that compensates for the brightness change; and transmitting the output signal to the display.

2. The method of claim 1, wherein obtaining the look-up table that corresponds to the reduced refresh rate of the input signal comprises linearly interpolating brightness signals for the reduced refresh rate based on brightness signals for a first refresh rate and a second refresh rate to form the look-up table that corresponds to the reduced refresh rate, wherein the reduced refresh rate is between the first refresh rate and the second refresh rate.

3. The method of claim 1, wherein each of the plurality of look-up tables includes separate brightness signals for red, green, and blue pixels.

4. The method of claim 1, wherein the input signal comprises a plurality of pixel levels or sub-pixel levels.

5. The method of claim 4, wherein the plurality of pixel levels or sub-pixel levels ranges from 0 to 255.

6. The method of claim 1, wherein each of the plurality of look-up tables is associated with a fixed refresh rate that is lower than a frame rate of the display.

7. The method of claim 6, wherein the frame rate of the display is 60 Hz.

8. The method of claim 1, wherein the reduced refresh rate is a fixed rate ranging from 5 Hz to 59 Hz.

9. The method of claim 1, wherein the reduced refresh rate comprises a plurality of refresh rates ramping down from a rate of 60 Hz to 5 Hz or ramping up from 5 Hz up to 60 Hz.

10. The method of claim 1, wherein the brightness signals comprise an actual brightness at the reduced refresh rate or a delta brightness between the brightness at the reduced refresh rate and the brightness at a frame rate of 60 Hz for each pixel level.

11. The method of claim 1, wherein the input signal includes a pixel level, and wherein adjusting the input signal comprises determining a brightness signal that corresponds to the pixel level based on the obtained look-up table and applying the brightness signal to the pixel level to compensate for the brightness change.

12. The method of claim 11, wherein applying the brightness signal to the pixel level increases a brightness of the display at the reduced refresh rate.

13. A display system that compensates for a brightness change that occurs when a refresh rate of the display is changed during a panel self-refresh, the display system comprising:

a time controller having a receiver, a transmitter, and a memory storing a plurality of look-up tables (LUT) each corresponding to a reduced refresh rate, each look-up table having a plurality of pixel levels and a plurality of brightness signals that provide compensation for the brightness change;

a graphics processing unit (GPU) coupled to the receiver of the time controller, wherein the receiver receives an input signal at the reduced refresh rate from the graphics processing unit;

a display coupled to the transmitter of the time controller, wherein the time controller compensates for the brightness change for an individual pixel or a sub-pixel based on the look-up table that corresponds to the reduced refresh rate of the input signal.

14. The display system of claim 13, wherein each of the plurality of look-up tables includes separate brightness signals for red, green, and blue pixels.

15. The display system of claim 13, wherein the input signal comprises a plurality of pixel levels or sub-pixel levels.

16. The display system of claim 13, wherein the plurality of pixel levels or sub-pixel levels ranges from 0 to 255.

17. The display system of claim 13, wherein the brightness signals comprise an actual brightness at the reduced refresh rate or a delta brightness between the brightness at the reduced refresh rate and the brightness at a frame rate of 60 Hz for each pixel level.

18. The display system of claim 13, wherein the reduced refresh rate is a fixed rate ranging from 5 Hz to 59 Hz.

19. The display system of claim 13, wherein the reduced refresh rate comprises a plurality of refresh rates ramping down from a rate of 60 Hz to 5 Hz or ramping up from 5 Hz up to 60 Hz.

20. The display system of claim 13, wherein each of the plurality of look-up tables is associated with a fixed refresh rate lower than a frame rate of the display.

21. The display system of claim 13, wherein the frame rate of the display is 60 Hz.

22. The display system of claim 13, wherein the display has a first brightness level at the refresh rate and a second brightness level at the reduced refresh rate, and wherein the time controller compensates for the brightness change such that the display has the first brightness level at the reduced refresh rate.

* * * * *